US007445488B2

(12) United States Patent
Feldmeier et al.

(10) Patent No.: US 7,445,488 B2
(45) Date of Patent: Nov. 4, 2008

(54) ELECTRICAL CONNECTING DEVICE AND METHOD FOR ITS PRODUCTION AND ELECTRICAL LINE AND SOLAR MODULAR ARRANGEMENT WITH A CONNECTING DEVICE OF THIS TYPE

(75) Inventors: Guenter Feldmeier, Lorsch (DE); Markus Strelow, Moerlenbach (DE); Heinz Scherer, Bensheim (DE); Andreas Woeber, Weinheim (DE)

(73) Assignee: Tyco Electronics AMP GmbH, Bensheim (DE)

( * ) Notice: Subject to any disclaimer, the term of this patent is extended or adjusted under 35 U.S.C. 154(b) by 0 days.

(21) Appl. No.: 11/770,103

(22) Filed: Jun. 28, 2007

(65) Prior Publication Data

US 2008/0014784 A1 Jan. 17, 2008

(30) Foreign Application Priority Data

Jul. 12, 2006 (DE) ..... 10 2006 032 275

(51) Int. Cl.
*H01R 9/07* (2006.01)

(52) U.S. Cl. ..... 439/394; 439/425; 439/606

(58) Field of Classification Search ..... 439/394, 439/425, 606, 604

See application file for complete search history.

(56) References Cited

U.S. PATENT DOCUMENTS 4,798,544 A * 1/1989 Hartman ..... 439/404
7,273,389 B2 * 9/2007 Hoppach et al. ..... 439/425

FOREIGN PATENT DOCUMENTS

| | | | |
|---|---|---|---|
| DE | 297 21 354 | U1 | 3/1998 |
| DE | 200 08 163 | U1 | 10/2000 |
| DE | 103 24 079 | A1 | 12/2003 |
| DE | 102 51 287 | A1 | 5/2004 |
| FR | 2759499 | | 8/1998 |
| GB | 2010027 | A | 6/1979 |
| JP | 2005-259507 | A | 9/2005 |

OTHER PUBLICATIONS

European Search Report dated Apr. 25, 2008 for Application No. EP 07 01 2300.

* cited by examiner

*Primary Examiner*—Gary F. Paumen
(74) *Attorney, Agent, or Firm*—Barley Snyder LLC

(57) ABSTRACT

An electrical connecting device includes a housing having a receiving channel that receives an electrical conductor. A contact element is seated in the housing. The contact element has a piercing element extending into the receiving channel that electrically contacts the electrical conductor. At least a portion of the housing and at least a portion of the electrical conductor in electrical contact with the piercing element are substantially surrounded by a common sheath made of a non-conductive material that forms a uniform bond with the housing and the electrical conductor.

17 Claims, 7 Drawing Sheets

ELECTRICAL CONNECTING DEVICE AND METHOD FOR ITS PRODUCTION AND ELECTRICAL LINE AND SOLAR MODULAR ARRANGEMENT WITH A CONNECTING DEVICE OF THIS TYPE

CROSS-REFERENCE TO RELATED APPLICATIONS

This application claims the benefit of the filing date under 35 U.S.C. § 119(a)-(d) of German Patent Application No. 10 2006 032 275.4, filed Jul. 12, 2006.

FIELD OF THE INVENTION

The invention relates to an electrical connecting device including a housing with a contact element having a piercing member that electrically contacts an electrical conductor.

BACKGROUND

A solar module for producing electrical energy typically comprises a layer arrangement consisting of a substantially planar front glass covering spaced from a rear glass covering. Individual solar cells, which contribute to the production of electrical energy by a photovoltaic effect, are arranged between the front glass covering and the rear glass covering and are connected to one another by an electrical connection system. Solar modules of this type, in which solar cells are arranged between a front glass covering and a rear glass covering, are electrically interconnected at points that are exposed to solar radiation. For ease of assembly and maintenance, plug connections are used for the electrical interconnection.

The plug connections, at their conventional site of use, for example, on the roof of a house, are exposed to weather and environmental influences such as snow, rain, frost or insolation and have to withstand these influences for years. In addition, mechanical stresses are endured during assembly and maintenance and mechanical tensile stresses are endured as a result of environmental influences. Additionally, in the case of large-area fields of solar panels, a large number of plug connections is required for the electrical connection of the solar panels. Thus, the individual plug connections not only have to be robust and reliable, but also economical.

BRIEF SUMMARY

The invention relates to an electrical connecting device of the type mentioned at the outset, which is suitable for comparatively rapid and simple assembly, in particular of a solar panel, and which can also be produced comparatively economically. In addition, a corresponding method for producing the electrical connecting device of this type is to be disclosed.

The electrical connecting device according to an embodiment of the invention comprises a housing having a receiving channel that receives an electrical conductor. A contact element is seated in the housing. The contact element has a piercing element extending into the receiving channel that electrically contacts the electrical conductor. At least a portion of the housing and at least a portion of the electrical conductor in electrical contact with the piercing element are substantially surrounded by a common sheath made of a non-conductive material that forms a uniform bond with the housing and the electrical conductor.

DETAILED DESCRIPTION OF THE EMBODIMENT(S)

Figure 1A:
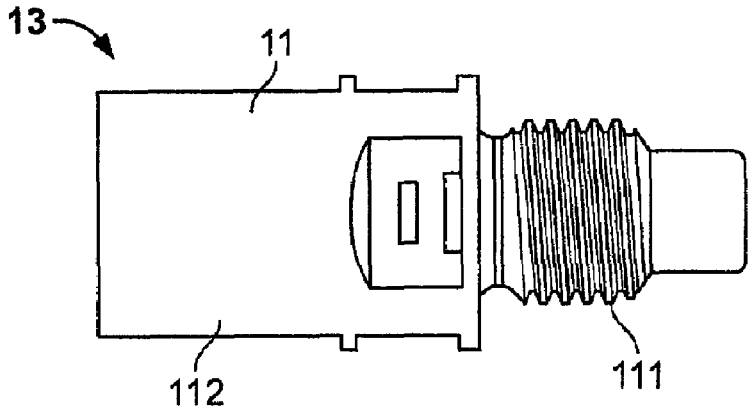
FIG. 1*a* is a side view of a negative coded connector housing according to an embodiment of an electrical connecting device according to the invention.
Figure 1B:
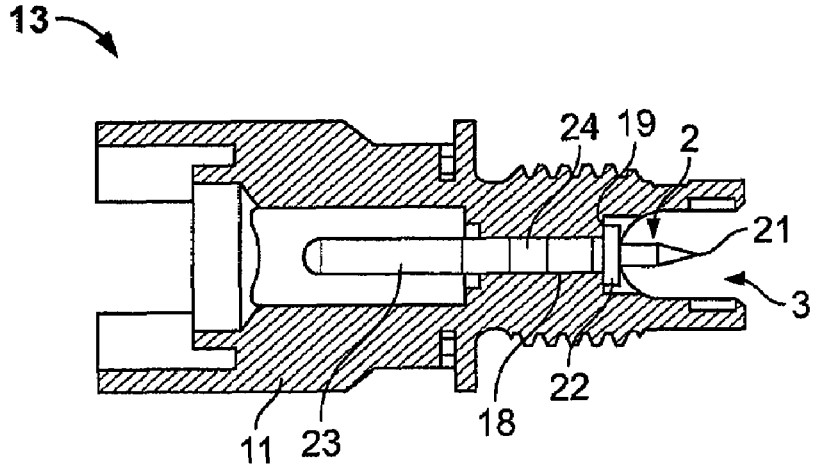
FIG. 1*b* is a sectional view of the housing in FIG. 1*a;*
Figure 2:
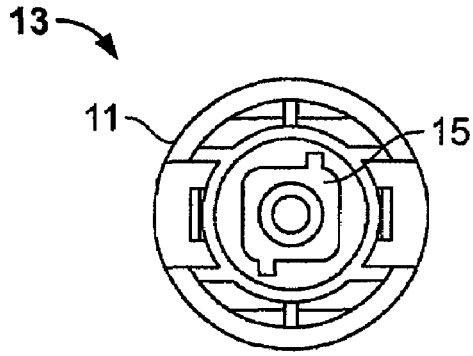
FIG. 2 is a bottom view of the housing in FIG. 1*a;*

FIGS. 1*a*-2 show an embodiment of a negative coded connector housing 11 of an electrical connecting device 1 (FIG. 6*a*) according to the invention. As shown in FIGS. 1*a*-1*b*, the housing 11 has a first portion 1ll and a second portion 112. The first portion 111 has a smaller external diameter than the second portion 112. As shown in FIG. 1*b*, the first portion 111 has a receiving channel 3 having a substantially U-shaped cross-section substantially matched to a diameter of an electrical conductor 5 (FIG. 5*a*), for example, an electrical cable, such that the electrical conductor 5 can rest therein. The receiving channel 3 communicates with a receiving opening 18 formed in the housing 11. A counter-stop 19 is formed between the receiving channel 3 and the receiving opening 18. The first portion 111 has an external thread. Although the external thread has no significance herein, the external thread is provided on the first portion 111, because the housing 11 is manufactured with a tool which is also used to produce other connector housings. In other words, to simplify manufacturing, the tool is also adjusted in this case such that the external thread is also provided on the first portion 111.

Figure 4:
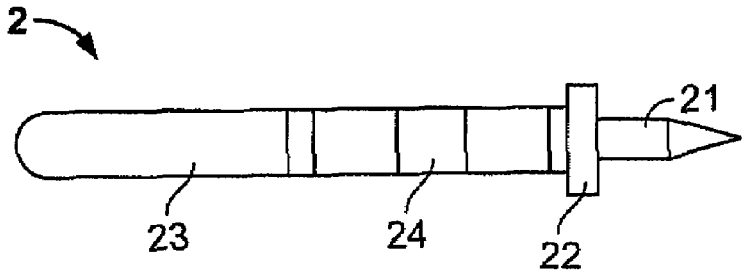
FIG. 4 is a side view of a contact element according to an embodiment of an electrical connecting device according to the invention.

As shown in FIG. 1*b*, a contact element 2 is provided in the housing 11. The contact element 2 may be made, for example, from copper. As shown in FIG. 4, the contact element 2 is configured as a contact pin and comprises a piercing element 21, a stop 22, a connection member 23, and a fixing member 24. As shown in FIG. 1*b*, the contact element 2 is pressed into the housing 11 to the stop 22, so that the stop 22 rests on the counter-stop 19. The contact element 2 is fixed by the engagement of the stop 22 with the counter-stop 19 in an axial direction. The fixing member 24 is seated in the receiving opening 18 of the housing 11, so that the contact element 2 is fixed in the housing 11 in a radial direction. The piercing element 21 projects into the receiving channel 3 of the housing 11. The piercing element 21 is configured in such a way that it can pierce or penetrate the insulation of the electrical conductor 5 (FIG. 5*c*) in order to make electrical contact therewith. The connection member 23 is oriented in the housing 11 to contact a counter-contact element (not shown). In particular, the connection member 23 of the contact element 2 and the second portion 112 of the housing 11 is configured as a plug connection 13 for contacting the counter-contact element (not shown). As shown in FIG. 2, the plug connection 13 has polarizing elements 15 that may be formed, for example, as polarizing ribs, which cooperate with corresponding polarizing ribs of the counter-contact element (not shown). This ensures that, in the housing 11, only a plug (not shown) provided for this purpose with the counter-contact element (not shown) can pierce the plug connection 13.

Figure 3A:
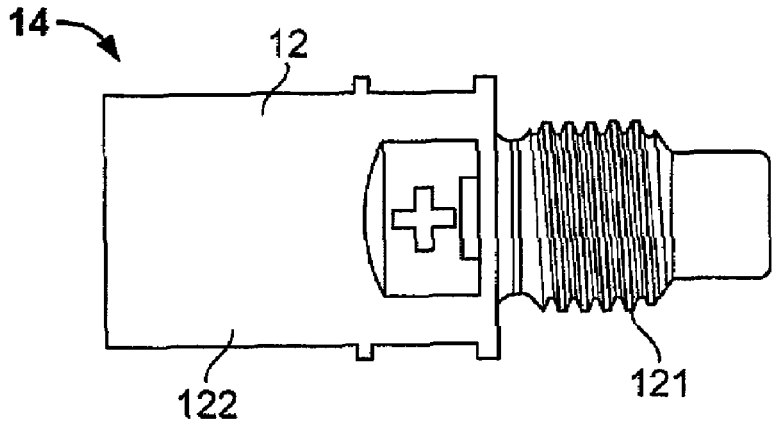
FIG. 3*a* is a side view of a positive coded connector housing according to an embodiment of an electrical connecting device according to the invention.
Figure 3B:
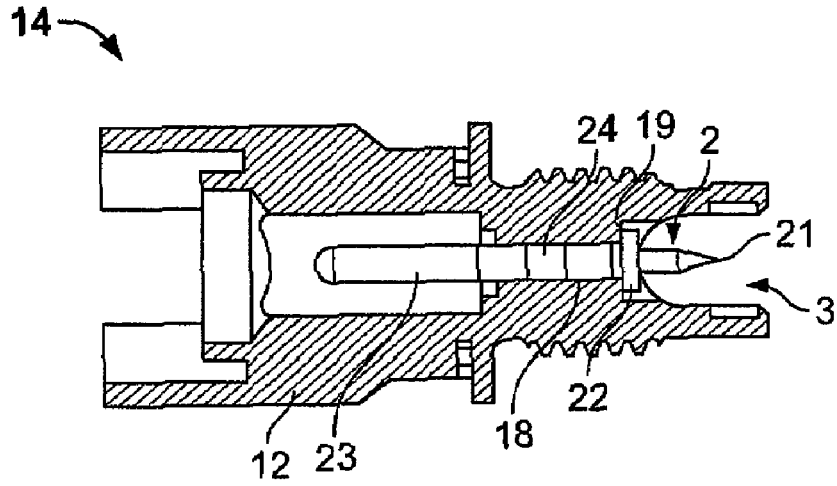
FIG. 3*b* is a sectional view of the housing in FIG. 3*a;*

FIGS. 3*a*-3*b* show an embodiment of a positive coded connector housing 12 of an electrical connecting device 1 (FIG. 6*a*) according to the invention. The housing 12 is substantially identical to the housing 11 in that the housing 12 includes a first portion 121, a second portion 122, a contact element 2, and a plug connection 14. Unlike the plug connection 13, however, the plug connection 14 has varying polarizing elements 15 formed, for example, as polarizing ribs, in order to prevent a counter-contact element (not shown) meant to be connected to the housing 12 from being connected to the housing 11 and vice versa.

Figure 5A:
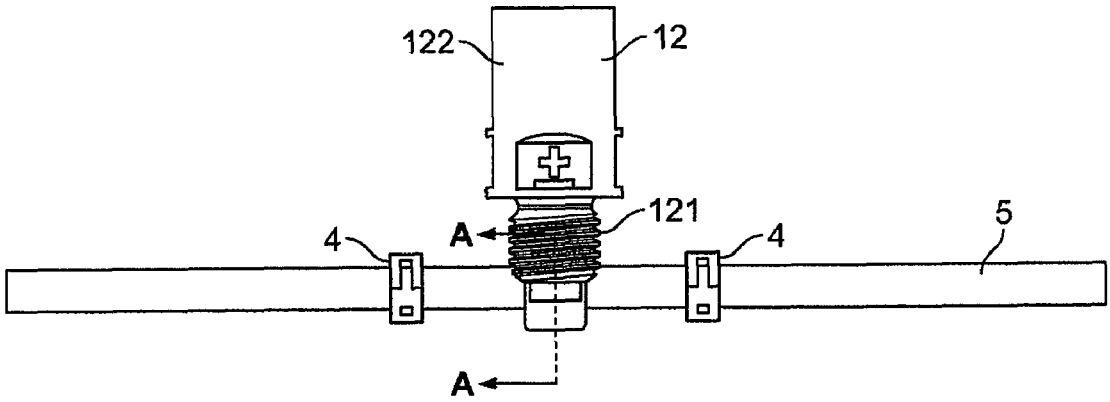
FIG. 5*a* is a schematic illustration of a side view of the electrical connecting device according to an embodiment of the invention prior to applying a sheath thereto.
Figure 5B:
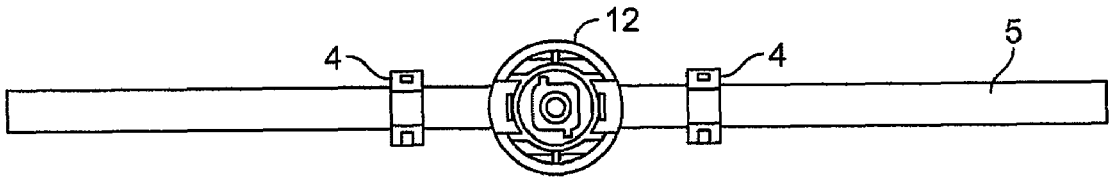
FIG. 5*b* is a schematic illustration of a bottom view of the electrical connecting device in FIG. 5*a;*
Figure 5C:
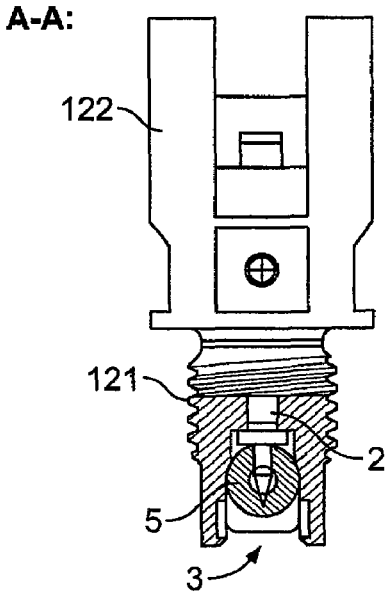
FIG. 5*c* is a schematic illustration of a sectional view of the electrical connecting device in FIG. 5*a;*

The method of assembly and use of the electrical connecting device 1 (FIG. 6*a*) according to the invention will now be described with reference to the housing 12. FIGS. 5*a*-5*c* show the electrical connecting device 1 (FIG. 6*a*) according to the invention in an intermediate state. As shown in FIGS. 5*a*-5*c*, the housing 12 is arranged such that the electrical conductor 5 is positioned in the receiving channel 3 of the housing 12. The housing 12 is pressed down onto the electrical conductor 5 in such a way that the piercing element 21 of the contact element 2 penetrates the insulation of the electrical conductor 5 and contacts an inner electrical conductor therein to make electrical contact therewith. An electrical connection between the electrical conductor 5 and an electrical device (not shown), which is connected to the counter-contact element (not shown), can then be produced, as previously described herein.

Figure 7:
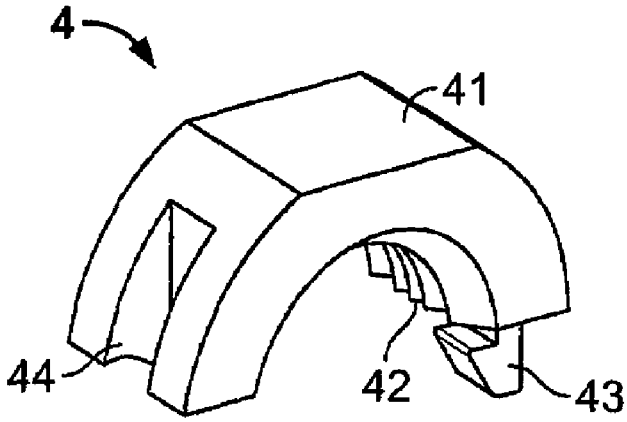
FIG. 7 is a perspective view of a clamping element according to an embodiment of the invention.

As shown in FIGS. 5*a*-5*b*, clamping elements 4, such as cable clamps, which slightly compress the insulation of the electrical conductor 5, are applied to the electrical conductor 5 on either side of the housing 12. As shown in FIG. 7, each of the clamping elements 4 has an upper portion 41 and a lower portion (not shown) identical in configuration to the upper portion 41. The clamping element 4 has ribs 42 for pressing into the insulation of the electrical conductor 5 and a latching connection 43, which latches with a corresponding latching connection on a lower portion (not shown) of the clamping element 4. The latching connection of the lower portion latches with the corresponding latching connection 44 of the upper portion 41.

Figure 6A:
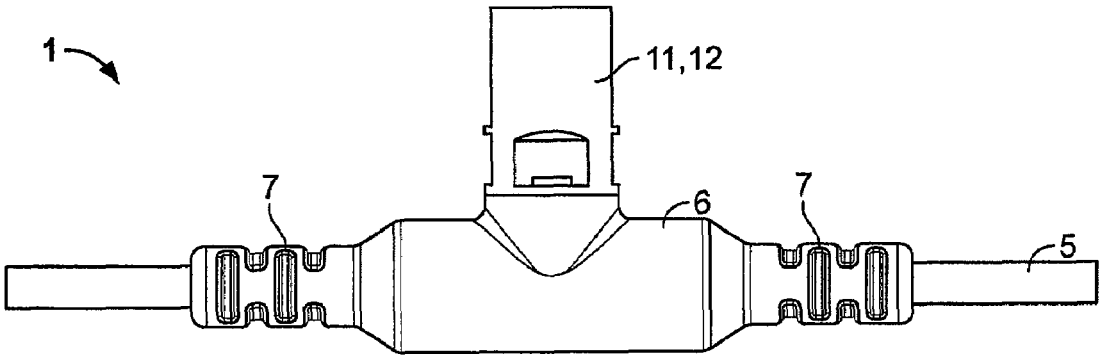
FIG. 6*a* is a schematic illustration of a side view of the electrical connecting device according to an embodiment of the invention after applying a sheath thereto.
Figure 6B:
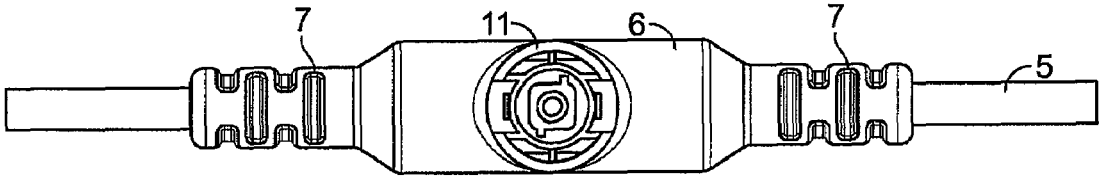
FIG. 6*b* is a schematic illustration of a bottom view of the electrical connecting device in FIG. 6*a;*
Figure 6C:
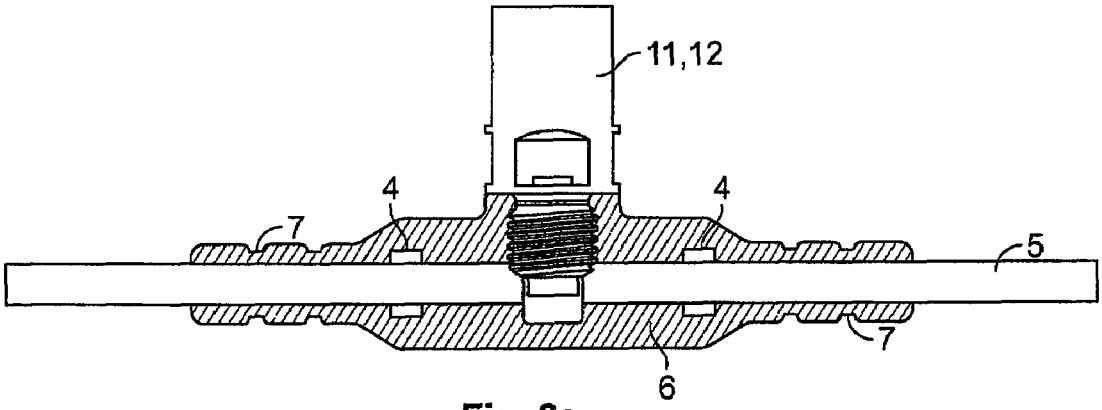
FIG. 6*c* is a schematic illustration of a partial longitudinal sectional view of the electrical connecting device in FIG. 6*a;*
Figure 6D:
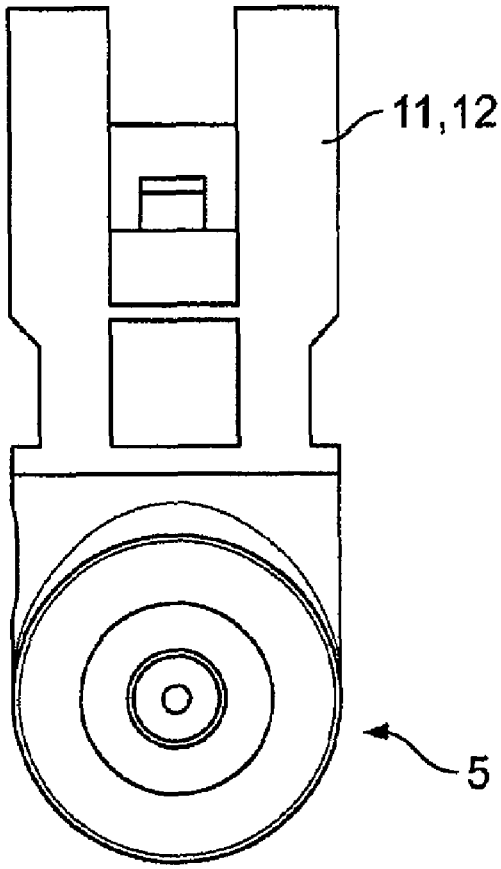
FIG. 6*d* is a schematic illustration of a side view of the electrical connecting device in FIG. 6*a;*

FIGS. 6*a*-6*d* show the electrical connecting device 1 according to the invention in a completed state described with reference to the housing 11 and the housing 12 (FIG. 6*b* only references the housing 11), since the basic principle of the arrangement of the electrical connecting device 1 on the electrical conductor 5 is independent of whether the housing 11 or the housing 12 is used. Once the electrical conductor 5 is arranged in the receiving channel 3 of the housing 11, 12 and the clamping elements 4 are attached to the electrical conductor 5, the first portion 111, 121 of the housing 11, 12 is injection molded around with a non-conductive material, such as a plastic material, so that the first portion 111, 121 of the housing 11, 12 and a corresponding portion of the contacted electrical conductor 5 are surrounded by a common sheath 6 made of the non-conductive material with the formation of a uniform bond. The clamping elements 4 are also surrounded by the sheath 6. The housing 11, 12 is fastened, fixed and stabilized by the sheath 6 on the electrical conductor 5. The second portion 112, 122 of the housing 11, 12 is configured in such a way that an outer surface thereof substantially borders an outer surface of the sheath 6 in a flush manner. Kink protection elements 7 are configured on electrical conductor end portions of the sheath 6, which prevent the electrical conductor 5 from kinking at points on either side of the housing 11, 12 where the sheath 6 ends. The kink protection elements 7 are formed in a manner known per se, as shown in FIGS. 6*a*-6*b*.

The sheath 6 may be formed, for example, from a thermoplastic elastomer (TPE), which has the desired properties for the purpose provided, such as flexibility and easy processability. In comparison, the housings 11, 12 and the clamping elements 4 may contain polycarbonate (PC) or are manufactured therefrom which can also be processed by the injection molding method. The combination of the materials TPE and PC for the production of the electrical connecting device 1 according to the invention, is advantageous in that the TPE adheres comparatively well to the PC. As a result, a reliable connection can be provided between the TPE of the sheath 6 and the PC of the clamping elements 4 and/or the housing 11, 12.

In the electrical connecting device 1 (FIG. 6*a*) according to the invention, the penetration of water traveling longitudinally along the electrical conductor 5 can be prevented by the insulation of the electrical conductor 5 being slightly pressed inward by the clamping elements 4 and further by the adhesion between the sheath 6 and the clamping elements 4. This applies equally to the connection between the housing 11, 12 and the sheath 6. A substantially watertight connecting device 1 is thus produced, irrespective of the material of the electrical conductor 5 used. In addition, the clamping elements 4 provide mechanical tensile stress relief at the point at which the contact element 2 pierces the electrical conductor 5, therefore it is possible to achieve a load distribution over the clamping elements 4 and the sheath 6 comparatively uniformly at a plurality of points. Further, because the first portion 111, 121 has a smaller external diameter than the second portion 112, 122 of the housing 11, 12, when only the first portion 111, 121 is to be injection molded around with the sheath 6, the surface then produced of the injection-molded material can equate to the diameter of the second portion 112, 122. Thus, a substantially identically shaped surface of the electrical connecting device 1 is produced.

Figure 8:
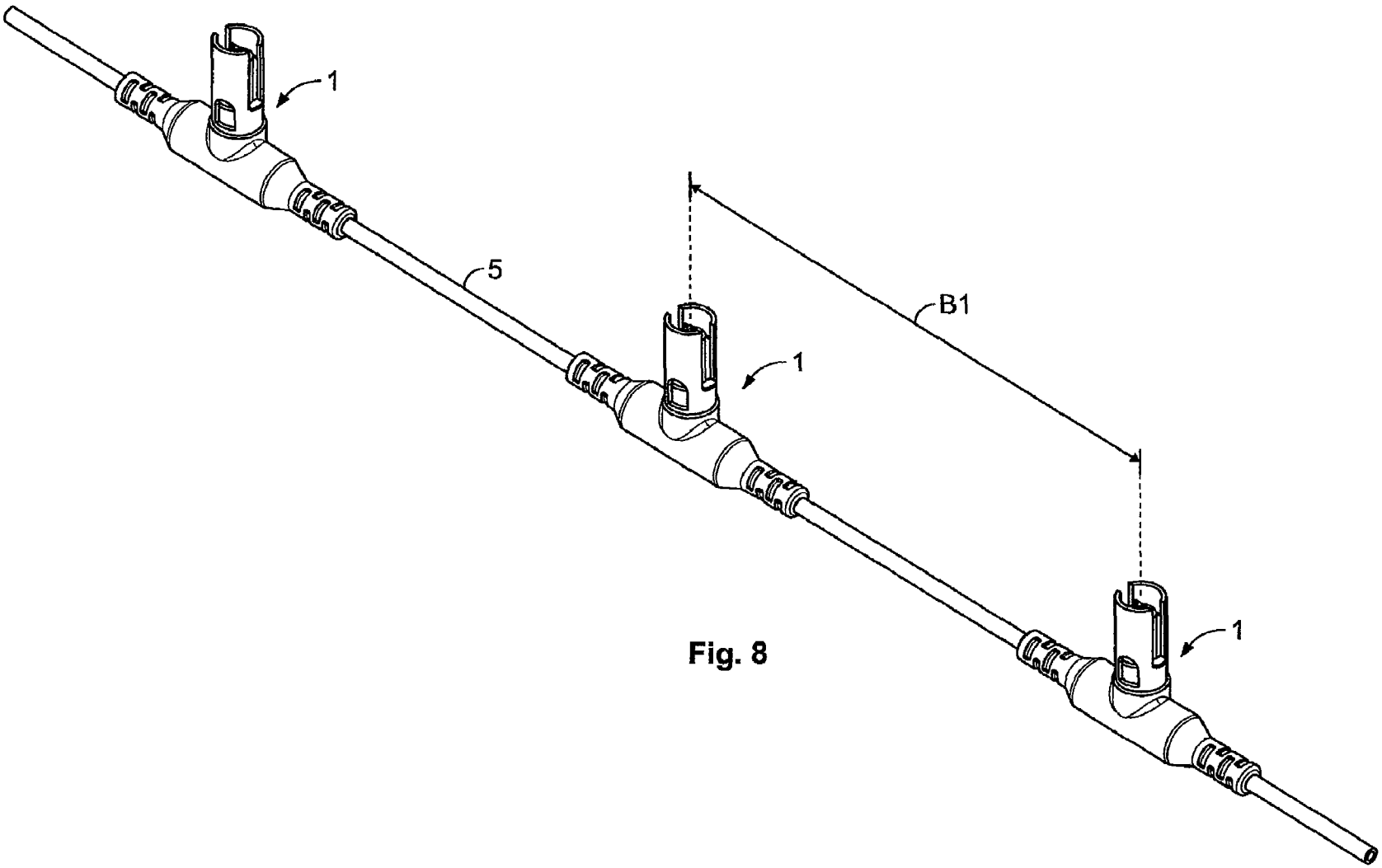
FIG. 8 is a schematic illustration of a perspective view of an electrical line provided with a plurality of the electrical connecting devices according to the invention.

FIG. 8 shows an electrical line provided with a plurality of the electrical connecting devices 1 according to the invention. As shown in FIG. 8, a plurality of the connecting devices 1, which are in the form of what are known as T-connectors, are arranged along the electrical conductor 5 in the manner of a daisy chain wherein each of the electrical connecting devices 1 are connected to one another in series along the electrical line via the electrical conductor 5. The connecting devices 1 are arranged at a spacing B1. The electrical conductor 5 may be, for example, an endless manufactured cable, which can be wound together with the connecting devices 1 onto a cable drum. The electrical conductor 5 can then be cut to a desired length at an assembly site. After laying the electrical conductor 5, a corresponding counter-contact element (not shown) only has to be introduced into the electrical connecting device 1, as previously described herein. A comparatively rapid and simple assembly can thus be achieved.

Figure 9:
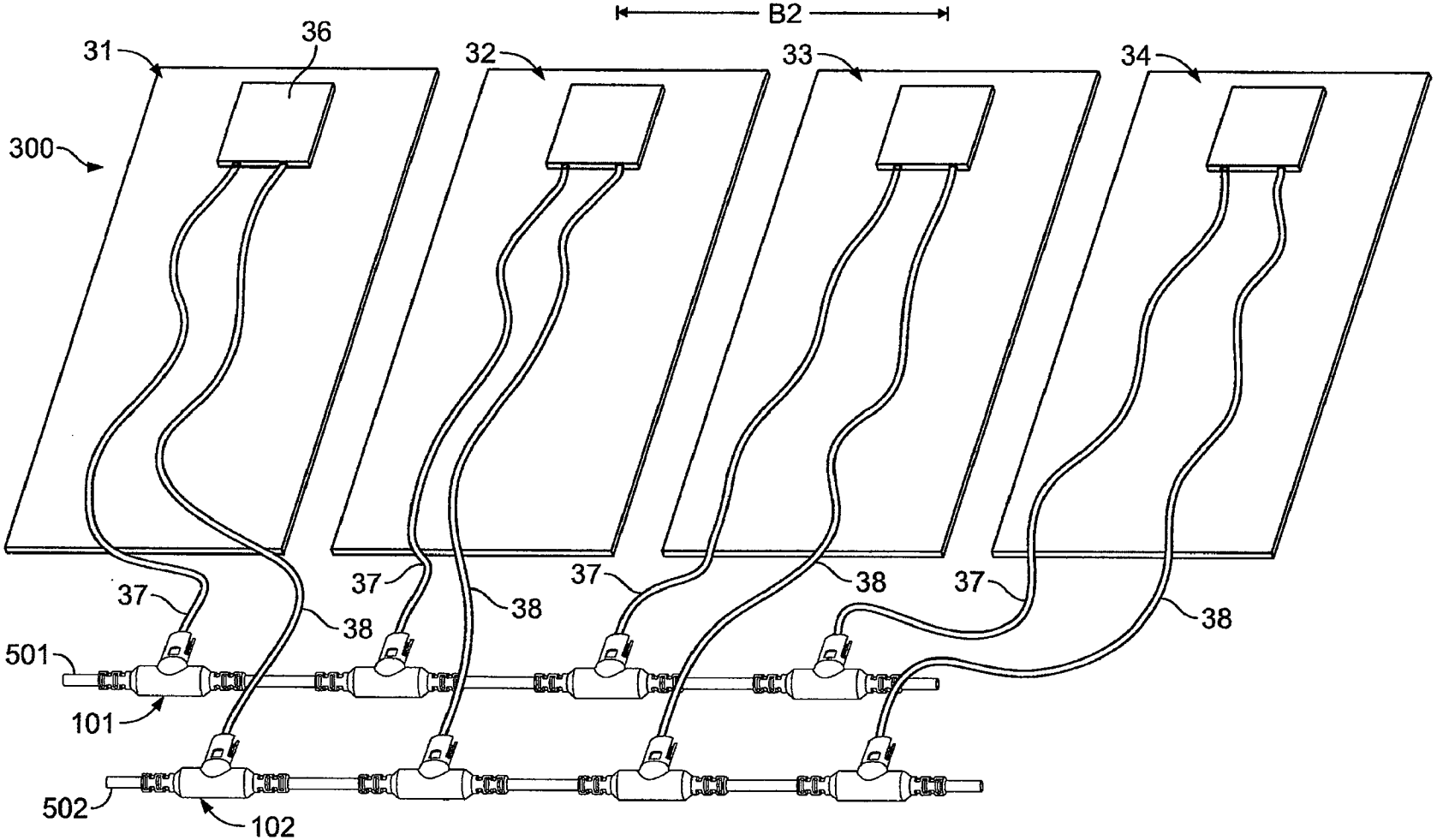
FIG. 9 is a schematic illustration of a perspective view of a solar module arrangement having electrical connection lines connected thereto with the electrical connecting devices according to the invention.

FIG. 9 shows a solar module arrangement 300 having electrical connection lines with at least one electrical conductor 501, 502 connected thereto wherein the electrical conductor 501, 502 is provided with electrical connecting devices 101, 102 according to the invention. The solar module arrangement 300 includes a plurality of solar modules 31, 32, 33, 34, which are connected to an external electrical connection system. For connection to the external electrical connection system, the solar modules 31, 32, 33, 34 each have electrical connections 36, such as connection boxes, which are connected to a rear glass covering of the respective solar module 31, 32, 33, 34. The solar modules 31, 32, 33, 34 are connected via solar connection cables 37, 38 to the electrical conductors 501, 502. The electrical conductor 501 has negative coded electrical connecting devices 101, while the electrical conductor 502 has positive coded electrical connecting devices 102, according to the structure described herein. The electrical connecting devices 101, 102 are arranged on the respective electrical conductors 501, 502 at a spacing B1 (FIG. 8), which corresponds with the length or width of the solar modules 31, 32, 33, 34, so the electrical conductors 501, 502 provide at least one electrical connecting devices 101, 102 at each of the solar modules 31, 32, 33, 34. The spacing B1 (FIG. 8) of the electrical connecting devices 101, 102 preferably amounts to a center distance B2 between adjacent solar modules 31, 32, 33, 34. Thus, an easy allocation can be produced between the electrical connecting devices 101, 102 and the respective solar module 31, 32, 33, 34. The electrical conductors 501, 502 can be laid at the assembly site of the solar modules 31, 32, 33, 34, so that it is possible to easily connect the solar modules 31, 32, 33, 34 to the electrical conductors 501, 502 by closing the respective plug connection at the respective electrical connecting devices 101, 102.

The foregoing illustrates some of the possibilities for practicing the invention. Many other embodiments are possible within the scope and spirit of the invention. For example, although the electrical connecting device 1 is described against the background of the electrical connection of the solar modules 31, 32, 33, 34, it is in no way limited thereto. Rather, use of the electrical connecting device 1 according to the invention is also conceivable in all other applications in which an electrical connection to the electrical conductor 5 is to be produced to connect, in particular, an electrical device of any type to the electrical conductor 5. The electrical connecting device 1 according to the invention may also be provided with a plurality of the contact elements 2 to facilitate connection to a multi-pole electrical conductor. It is, therefore, intended that the foregoing description be regarded as illustrative rather than limiting, and that the scope of the invention is given by the appended claims together with their full range of equivalents.

What is claimed is:

1. An electrical connecting device, comprising:

an electrical conductor;

a housing having a receiving channel that receives the electrical conductor;

a contact element seated in the housing, the contact element having a piercing element extending into the receiving channel that electrically contacts the electrical conductor;

at least a portion of the housing and at least a portion of the electrical conductor in electrical contact with the piercing element being substantially surrounded by a common sheath made of a non-conductive material that forms a uniform bond with the housing and the electrical conductor; and the electrical connecting device is T-shaped.

2. The electrical connecting device of claim 1, wherein the sheath is an injection molded plastic material.

3. The electrical connecting device of claim 2, wherein the housing is made from a polycarbonate and the sheath is made from a thermoplastic elastomer.

4. The electrical connecting device of claim 1, further comprising clamping elements attached to the electrical conductor on opposite sides of where the electrical conductor is in electrical contact with the piercing element.

5. The electrical connecting device of claim 4, wherein the clamps are surrounded by the sheath.

6. The electrical connecting device of claim 1, wherein the receiving channel has a substantially U-shaped cross-section substantially matched to a diameter of the electrical conductor.

7. The electrical connecting device of claim 1, wherein the contact element includes a connection member arranged opposite the piecing element that makes electrical contact with a counter-contact element.

8. The electrical connecting device of claim 7, wherein the connection member of the contact element together with at least a portion of the housing is a plug connection for contacting the counter-contact element.

9. The electrical connecting device of claim 8, wherein the plug connection has at least one polarization element for cooperating with a corresponding polarization element of the counter-contact element.

10. The electrical connecting device of claim 1, wherein the housing includes a first portion and a second portion, the first portion having a smaller diameter than the second portion, the first portion containing the piercing member of the contact element, and the sheath substantially surrounds the first portion.

11. The electrical connecting device of claim 10, wherein an outer surface of the sheath is substantially flush with an outer surface of the second portion.

12. The electrical connecting device of claim 1, wherein the sheath is provided with kink protection members on opposite sides of where the electrical conductor is in electrical contact with the piercing element.

13. The electrical connecting device of claim 1, wherein the electrical conductor is received in the receiving channel of more than one of the housings, is in electrical contact with the contact elements seated therein, and each of the housings is substantially surrounded by the common sheath.

14. The electrical connecting device of claim 13, wherein the housings are spaced apart along the electrical conductor.

15. The electrical connecting device of claim 13, wherein each of the housings is connected in series.

16. The electrical connecting device of claim 13, wherein a plurality of solar modules are electrically connected to the electrical conductor through the contact elements.

17. The electrical connecting device of claim 16, wherein the housings are spaced apart along the electrical conductor such that each of the housings are associated with one of the solar modules.

* * * * *